US010315207B2

(12) United States Patent
Le Cardinal et al.

(10) Patent No.: US 10,315,207 B2
(45) Date of Patent: Jun. 11, 2019

(54) PNEUMATIC SPRAYING ASSEMBLY, RESTRICTOR FOR SUCH AN ASSEMBLY AND INSTALLATION FOR PROJECTING A COATING PRODUCT COMPRISING SUCH AN ASSEMBLY OR SUCH A RESTRICTOR

(71) Applicant: Exel Industries, Epernay (FR)

(72) Inventors: Johan Le Cardinal, Paris (FR); Thibault Cognon, Paris (FR)

(73) Assignee: Exel Industries, Epernay (FR)

( * ) Notice: Subject to any disclaimer, the term of this patent is extended or adjusted under 35 U.S.C. 154(b) by 0 days.

(21) Appl. No.: 15/792,783

(22) Filed: Oct. 25, 2017

(65) Prior Publication Data

US 2018/0126397 A1 May 10, 2018

(30) Foreign Application Priority Data

Nov. 4, 2016 (FR) ..... 16 60689

(51) Int. Cl.

| | |
|---|---|
| ***B05B 1/30*** | (2006.01) |
| ***B05B 7/02*** | (2006.01) |
| ***B05B 7/04*** | (2006.01) |
| ***B05B 7/12*** | (2006.01) |
| ***B05B 7/24*** | (2006.01) |

(52) U.S. Cl.

CPC ..... *B05B 7/12* (2013.01); *B05B 1/30* (2013.01); *B05B 7/02* (2013.01); *B05B 7/0416* (2013.01); *B05B 7/2489* (2013.01)

(58) Field of Classification Search

CPC B05B 7/12; B05B 7/02; B05B 7/0416; B05B 7/2489; B05B 1/30

USPC ..... 239/329, 331, 332, 333, 526, 590

See application file for complete search history.

(56) References Cited

U.S. PATENT DOCUMENTS

| | | | | |
|---|---|---|---|---|
| 2,504,117 A | | 4/1950 | Downs | |
| 2,513,081 A | | 6/1950 | Clark et al. | |
| 5,887,801 A | * | 3/1999 | Stevens | A62C 33/00 239/590 |
| 2006/0219824 A1 | | 10/2006 | Alexander et al. | |

FOREIGN PATENT DOCUMENTS

EP 0720869 A2 7/1996

OTHER PUBLICATIONS

French Patent Application No. 16 60689, Rapport de Recherche Préliminaire, Jun. 23, 2017, 2 pages.

* cited by examiner

*Primary Examiner* — Christopher S Kim
(74) *Attorney, Agent, or Firm* — Soquel Group LLC

(57) ABSTRACT

A pneumatic spraying assembly for a coating product including a pneumatic sprayer and a supply line for the pneumatic sprayer from a pressurized coating product source to which the supply line is connected by its upstream end, the pneumatic sprayer including a sprayer body and a control valve for controlling flow of the coating product toward a spraying area for the coating product, the controlling valve including a needle selectively closing off an outlet orifice of an inner volume of the sprayer body and the spraying assembly defining a flow path for the coating product, from the upstream end of the supply line to the outlet orifice of the inner volume, wherein a restrictor for restricting flow of the coating product is mounted on the flow path to create a pressure loss upstream from the outlet orifice.

17 Claims, 6 Drawing Sheets

PNEUMATIC SPRAYING ASSEMBLY, RESTRICTOR FOR SUCH AN ASSEMBLY AND INSTALLATION FOR PROJECTING A COATING PRODUCT COMPRISING SUCH AN ASSEMBLY OR SUCH A RESTRICTOR

CROSS REFERENCE TO RELATED APPLICATIONS

This application claims priority under 35 USC § 119 of French Patent Application No. 16 606899 filed on Nov. 4, 2016.

FIELD OF THE INVENTION

The invention relates to a pneumatic spraying assembly for spraying a coating product intended to be used in a coating product spraying installation, as well as a restrictor forming a spare part for such an assembly and a coating product spraying installation comprising such a sprayer and/or such a restrictor.

BACKGROUND OF THE INVENTION

In an installation for spraying a coating product, it is known to supply one or several manual or automatic sprayers with a pressurized coating product, as well as with air for spraying this coating product. To that end, it is known to use a pump capable of delivering both pressurized air and pressurized coating product. In some cases, there may be several sprayers. In this case, each sprayer can be supplied by a hose with a different length and/or diameter. In this type of installation, in order to have the same flow rate for each sprayer, pressure regulators are mounted on the pump or the part of the pump that delivers the pressurized coating product. The regulators are used to avoid or limit pressure fluctuations in a hose supplying the sprayer with coating product and to adjust the pressures in each hose independently, in order to obtain an iso-pressure at each sprayer.

Some coating products, like those used to apply a color on wood, are very liquid, i.e., have a particularly low viscosity, close to that of water. To apply such coating products, the supply pressure of the spraying area of a sprayer must be low, in particular below 0.5 bars. Under these conditions, a volume provided inside the body of a sprayer to supply this spraying area most in turn be at a low pressure. This involves supplying the sprayer with a low-pressure coating product, which causes the regulator to operate outside its nominal pressure range, to the point that it is no longer effective and no longer makes it possible to hide travel inversions of the pump. This results in pressure fluctuations in the supply hose of the sprayer, which leads to an irregular application of the coating product.

SUMMARY OF THE DESCRIPTION

The invention more particularly aims to resolve these drawbacks by proposing a new pneumatic spraying assembly for a coating product that makes it possible to supply a spraying area with a low-pressure coating product, without any risk of causing a pressure limiter to operate outside its operating range.

To that end, the invention relates to a pneumatic spraying assembly for a coating product, comprising a pneumatic sprayer for spraying the coating product and a supply line for supplying this pneumatic sprayer from a pressurized coating product source to which the supply line is connected by its upstream end, the pneumatic sprayer comprising a sprayer body and a control valve for controlling flow of the coating product toward a spraying area for this product, this valve comprising a needle selectively closing off an outlet orifice of an inner volume of the sprayer body and the spraying assembly defining a flow path for the coating product, from the upstream end of the supply line to the outlet of the inner volume. According to the invention, a restrictor for restricting flow of the coating product is mounted on the flow path to create a pressure loss upstream from the outlet orifice.

Owing to the invention, the pressure loss created by the restrictor upstream from the sprayer makes it possible to keep a relatively high pressure in the upstream part of the supply line of the coating product sprayer, while the pressure in the inner volume of the body of the sprayer can be low enough, in particular below 0.7 bars, to allow a low-pressure supply of the spraying area. Thus, a pressure regulator arranged at the outlet of a supply pump of the sprayer can be implemented in its nominal operating pressure range, such that it remains effective, even when the pressure of the sprayed coating product is low.

In the present description and in the attached claims, the pressures indicated are relative and dynamic pressures, i.e., measured when the coating product circulates in the supply pipes and volume of the spraying area.

According to advantageous but optional aspects of the invention, such an assembly may incorporate one or more of the following features, considered in any technically allowable combination:

- The restrictor is mounted in the inner volume of the body of the sprayer.
- The restrictor divides the inner volume into two chambers and connects these two chambers by at least one calibrated pipe.
- The flow path includes a connecting member for connecting the supply line on the sprayer body and the restrictor is mounted in the connecting member.
- The connecting member is configured so as, in the absence of the restrictor, to cooperate with a mechanism arranged at an outlet of the supply line in order to connect the pneumatic sprayer to the supply line, while the connecting member is configured also to cooperate with this mechanism when the restrictor is mounted in an intake coupling for the coating product.
- The restrictor has a mouth with the same geometry as the geometry of a mouth of the connecting member.
- The restrictor is made from a material more flexible than the material of the connecting member, in particular a synthetic material, which favors sealing.
- The restrictor is mounted reversibly in the inner volume of the body of the sprayer or in the connecting member.

According to another aspect, the invention relates to a restrictor forming a spare part for an assembly as described above. This restrictor is formed by a part that defines at least one calibrated pipe for flow of a coating product, having a length comprised between 1 and 25 mm, preferably between 8 and 15 mm, still more preferably about 10 mm, and having a maximum transverse dimension less than 2 mm, preferably comprised between 0.5 and 1.8 mm.

It is possible to provide that an end of the restrictor, which defines a mouth thereof, has frustoconical outer and inner shapes with apical angles having the same value. This allows the restrictor to be placed in a traditional coupling member of the sprayer with the supply line.

According to still another aspect, the invention relates to an installation for spraying coating product, that comprises at least one reservoir for the coating product, at least one pneumatic sprayer for the coating product, a supply pump for supplying the at least one sprayer with the coating product from the at least one reservoir, as well as a supply line for supplying the at least one pneumatic sprayer from the supply pump. According to the invention, the pneumatic sprayer and the supply line form an assembly as described above and/or comprise a restrictor as described above.

Owing to the invention, the restrictor makes it possible to create a controlled pressure loss and to obtain, within the installation, the same pressure in each sprayer, while using a single pressure regulator, even in the case where there are several sprayers connected on the same outlet of the regulator.

Advantageously, the supply pump is equipped, at its outlet, with a pressure regulator adjusted to deliver the coating product to a supply line of the coating product sprayer, under a pressure comprised between 0.5 and 3 bars, while the restrictor is configured to deliver the coating product to the outlet orifice of the inner volume of the body of the sprayer under a pressure below 1 bar, preferably between 0.3 and 0.7 bars.

BRIEF DESCRIPTION OF THE DRAWINGS

The invention will be better understood, and other advantages thereof will appear more clearly, in light of the following description of two embodiments of a spraying assembly, a restrictor and an installation for spraying coating product according to its principle, provided solely as an example and done in reference to the appended drawings, in which.

DETAILED DESCRIPTION

Figure 1:
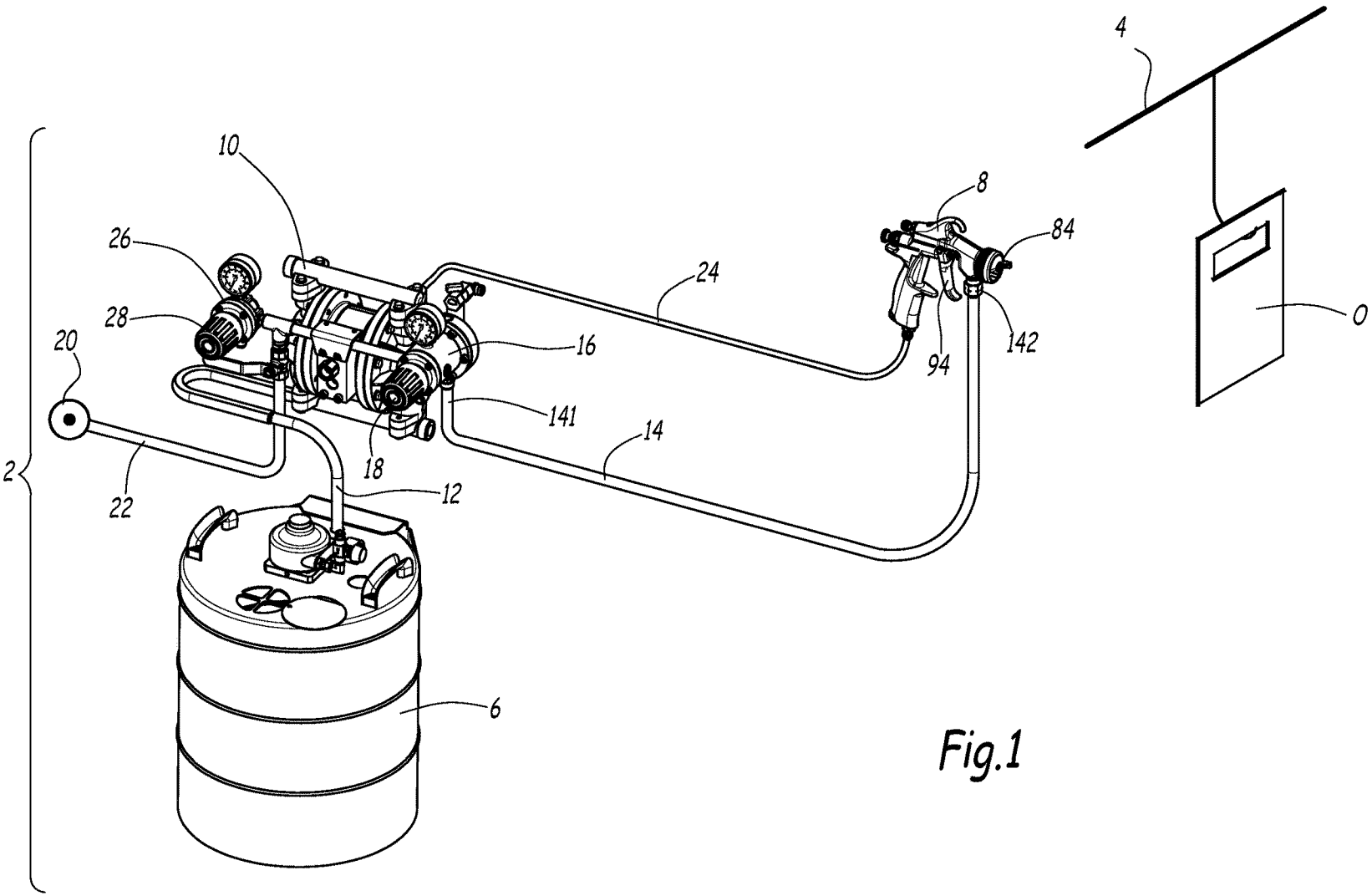
FIG. 1 is a schematic perspective illustration of an installation for spraying coating product according to the invention.

The installation 2 shown in FIG. 1 is intended to coat objects O, such as wood panels transported by a conveyor 4, with a liquid coating product stored in a reservoir 6.

To that end, the installation 2 comprises a sprayer 8, which here is formed by a pneumatic gun, of the "Airspray" type, intended to be manipulated by an operator.

In an alternative that is not shown, the sprayer 8 is a sprayer of the automatic pneumatic Airspray type intended to be mounted on a support, optionally mobile, and controlled by an automaton.

The installation 2 also comprises a pump 10 connected to the reservoir 6 by a suction tube 12. The pump 10 is also connected to the sprayer 8 by a supply line 14 supplying the sprayer with pressurized coating product. A pressure regulator 16 is mounted at the outlet of the pump 10, on the side of the line 14, and makes it possible to regulate the pressure of the coating product circulating in this line, based on a setpoint value adjusted using a button 18. Reference 141 denotes the upstream end of the line 14 by which this line is connected on the regulator 16.

The pump 10 delivers the coating product under a pressure comprised between 2 and 40 bars. The pressure regulator is built such that the setpoint value is comprised between 0.5 and 3 bars. In other words, the pressure regulated in the hose 14 may normally be adjusted between 0.3 and 3 bars.

Furthermore, the pump 10 is connected to an air source 20 that may be a compressed air source. An air suction tube 22 connects the source 20 to the pump 10.

A supply line 24 supplying the sprayer 8 with air connects the pump 10 to the sprayer 8. A regulator 26 is mounted at the outlet of the pump 10, at the beginning of the line 24, and makes it possible to adjust the air pressure in this hose 24 using a control button 28.

In practice, in the illustrated case of the gun-type sprayer 8, the lines 14 and 24 can be formed by flexible hoses.

Figure 2:
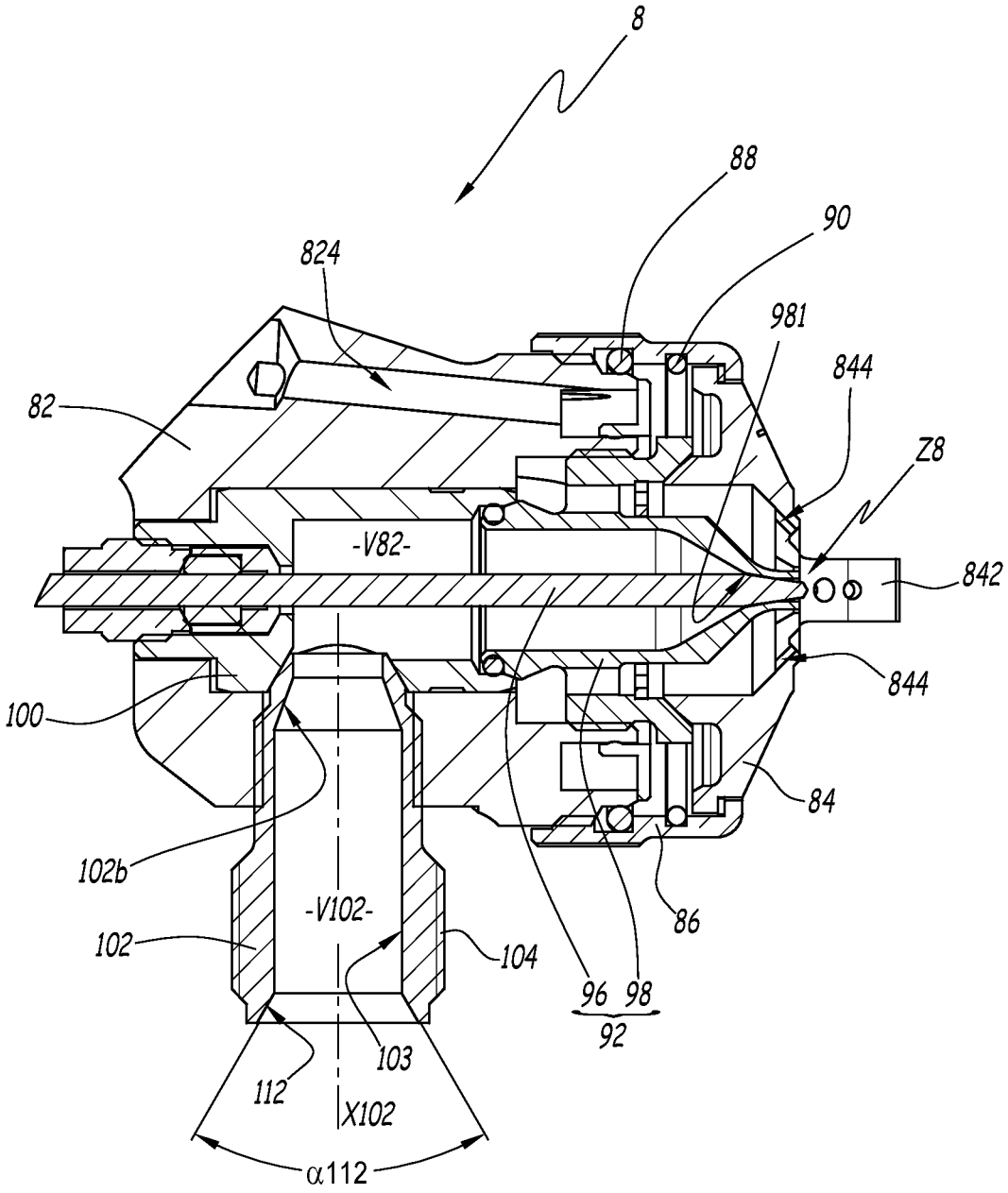
FIG. 2 is a longitudinal sectional view of the front part of a sprayer belonging to a spraying assembly according to the invention belonging to the installation of FIG. 1.
Figure 4:
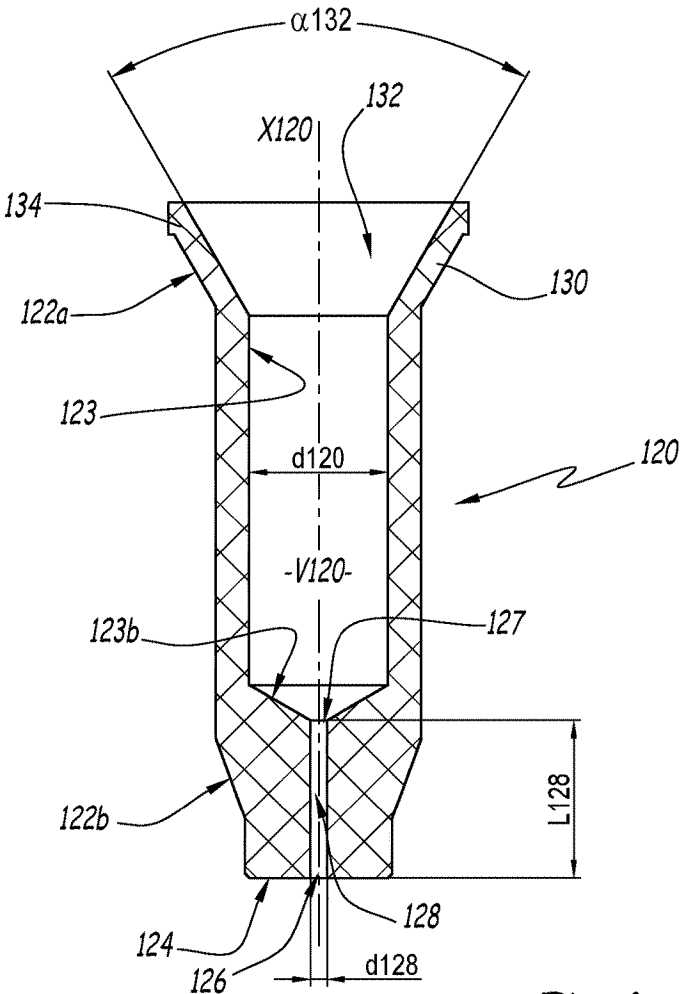
FIG. 4 is a sectional view along line IV-IV in FIG. 3.
Figure 3:
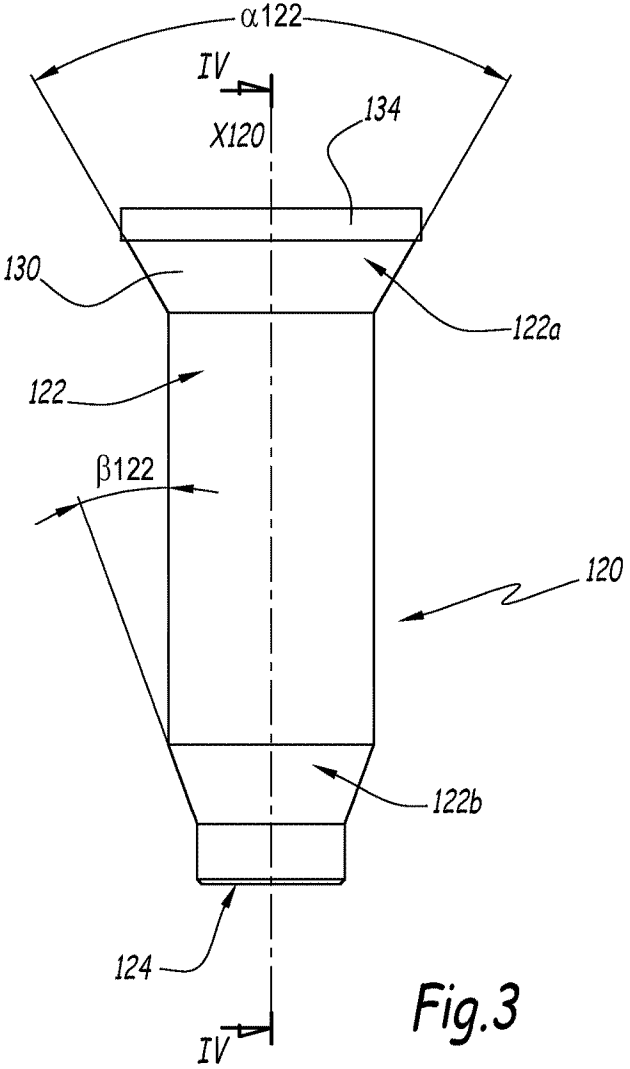
FIG. 3 is a side view of a restrictor intended to be used with the sprayer of FIG. 2.

As in particular shown in FIG. 2, the sprayer 8 comprises a body 82 on which a head or cap 84 immobilized by a nut 86 is mounted, with interposed sealing gaskets 88 and 90.

In the example, the head 84 is intended to deliver a flat jet and to that end comprises two horns, only one of which is visible in FIG. 2 with references 842. The head is provided with air circulation channels coming from the hose 24. Some of these channels are visible in FIG. 2 with reference 844.

The body 82 is in turn provided with air circulation channels 824 from a connecting zone of the hose 24 on the body 82 and up to the inside of the head 84. Only one of these channels is visible in FIG. 2, having specified that the number and depiction of the channels 824 and 844 are not limiting, nor is their number.

Furthermore, the sprayer 8 comprises a valve 92 that makes it possible to control the coating product outlet using a trigger 94. The valve comprises a needle 96 and a nozzle 98 that defines a seat 981 on which the needle 96 bears in the closed configuration of the valve 92 shown in FIGS. 2, 5 and 6.

The nozzle 98 cooperates with a sleeve 100 arranged inside the body 2 to define an inner volume V82 of the body 82, which is intended to receive the coating product flowing toward an outlet orifice 982 of the nozzle 98. Downstream from this outlet orifice 982, a spraying area Z8 of the sprayer 8 is formed in which the coating product leaving the volume V82 through the orifice 982 is sprayed by air coming from the channels 844 and shaped by the air coming from the channels arranged in the horns 842.

A connecting member 102 is mounted on the body 82 such that its inner volume V102 is in communication with the volume 82. In the example, the member 102 is screwed on the body 82. This connecting member 102 is intended to be coupled to the downstream end 142 of the supply pipe 14. It thus constitutes part of an intake coupling for the coating product in the body 82, more particularly in the volume V82. The member 102 is sometimes called "intake coupling".

The connecting member 102 is equipped with an outer thread 104 intended to cooperate with a nut 106 mounted freely rotating around a coupling element 108 provided with a crenulated rod introduced and immobilized by shape cooperation in the downstream end 142 of the supply pipe 14. The elements 108 and 110 are visible in FIG. 6.

The connecting member 102 is provided with a frusto-conical mouth 112 converging toward the body 82. Furthermore, the coupling element 108 is provided with a front surface 114, also frustoconical and with a geometry complementary to that of the mouth 112.

It is thus possible to fluidly connect the member 102 and the element 108 by causing the surface 114 to bear on the mouth 112 and by screwing the nut 106 on the thread 104. This configuration is not shown in the figures, but can be deduced from the geometry of the parts 102, 106 and 108. The member 102 and the element 108 therefore form two parts of a supply coupling supplying the sprayer 8 with coating product.

A flow path C for pressurized coating product is defined between the end 141 of the line 14 and the orifice 982. This flow path C comprises the inner volume of the hose forming the supply line 14, the inner volume V102 of the member 102 and the inner volume V82.

According to the invention, a restrictor 120 is mounted in the volume V102, i.e., within the flow path C, in order to create a pressure loss on the path of the coating product, upstream from the volume V82.

The restrictor 120 is in a single piece and has a circular section. Its outer surface 122 is complementary to the inner surface 103 of the member 102, which also has a circular section. References X102 and X120 respectively denote longitudinal and central axes of the parts 102 and 120. The outer surface 122 comprises a frustoconical section 122*a* with a shape complementary to the mouth 112. In particular, the apical angle a122 of the section 122*a* is the same as the apical angle a112 of the mouth 112. This allows surface bearing of the section 122*a* on the mouth 112.

The restrictor 120 comprises a downstream end 124 that has the smallest outer diameter of the restrictor 120 and that is intended to be engaged up to the bottom of the volume V102 toward the volume V82. The end surface 124*a* of the end 124 is in the form of an annular disc centered on the axis X120 of the restrictor 120 and pierced with an orifice 126 that constitutes the outlet of a calibrated pipe 128 with a circular section arranged in the restrictor 120 and centered on the axis X120. The surface 124*a* participates in limiting the volume V82.

Figure 5:
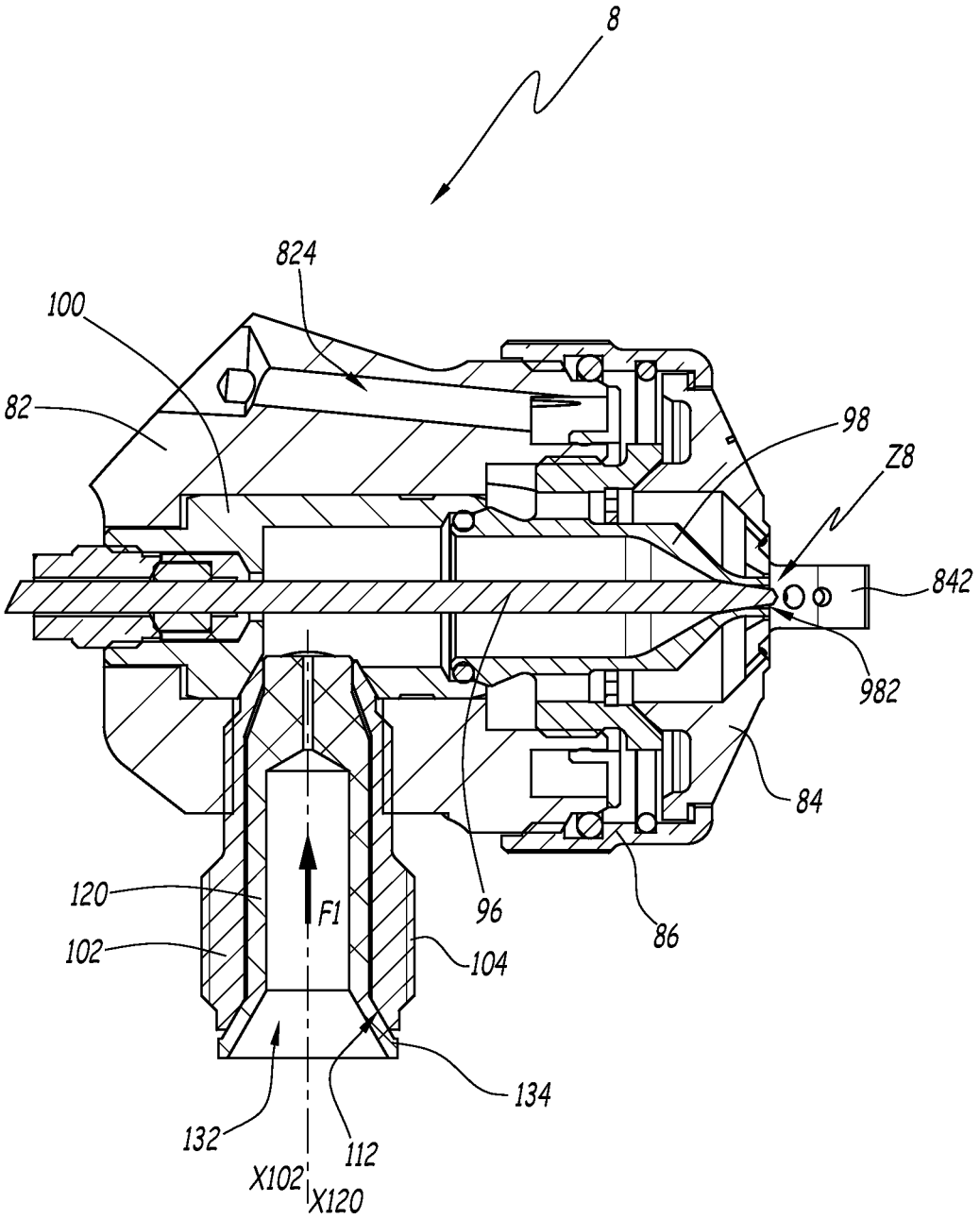
FIG. 5 is a sectional view similar to FIG. 2, when the sprayer is equipped with the restrictor of FIGS. 3 and 4.

Reference 130 denotes the upstream end of the restrictor 120, opposite the downstream end 124 and which defines a mouth 132 of this restrictor. This mouth has a frustoconical shape. Reference a132 denotes its apical angle. The angles a122 and a132 have the same value. In other words, the upstream end 130 of the restrictor 120 has frustoconical outer and inner shapes, with a constant thickness over its length except at an end collar 134 that protrudes from the volume V102 in the configuration of the restrictor 120 mounted in the connecting body 102, as shown in FIG. 5.

In practice, the angles a112, a122 and a130 can have a value comprised between 45° and 70°, preferably equal to 60°.

Between the mouth 132 and the pipe 128, along the axis X120, the restrictor 120 defines an inner volume V120, the diameter of which is denoted d120. This volume V120 forms a passage chamber for the coating product between the mouth 132 and the calibrated pipe 128.

Reference L128 denotes the length of the pipe 128 measured parallel to the axis X120. Reference d128 denotes the diameter of this pipe.

These dimensions L128 and d128 are selected so as to create a significant pressure loss during the passage of the coating product from the volume V120 toward the volume V82.

In practice, the length L128 is chosen between 1 and 25 mm, preferably between 8 and 15 mm, still more preferably about 10 mm, while the diameter d128 is chosen to be less than 2 mm, preferably between 0.5 and 1.8 mm. The diameter d128 is strictly smaller than the diameter d120 and the inner surface 123 of the restrictor 120 comprises a frustoconical section 123*b* converging toward the mouth 127 of the calibrated pipe 128.

In the example, the frustoconical section 123B results in the cross-section of the flow path gradually decreasing between that of the hose forming the line 14, which is substantially equal to that of the inner volume V120, and that of the calibrated pipe 128. This avoids creating nooks where the coating product may become blocked.

Alternatively, the pipe 128 does not have a circular section. In this case, its maximum transverse dimension is selected as being smaller than 2 mm, preferably comprised between 0.5 and 1.8 mm. In the case of a pipe with a circular section, its maximum transverse dimension is equal to the diameter d128 of this pipe 128.

To install the restrictor 120 in the intake coupling 102, it suffices to align the axes X120 and X102 of the volume V102 and to push the restrictor 120 toward the volume V82 in a direction pushing into the inside of the coupling 102, shown by arrow F1 in FIG. 5, until causing a second frustoconical section 122*b* of the surface 122 and the section 122*a* respectively to engage in surface bearing on a frustoconical section 102*b* of the inner surface of the coupling 102 and against the mouth 112.

The apical half angles β102 and β122 of the surfaces 102*b* and 122*b* are equal, with a value comprised between 15° and 30°, preferably equal to 20°.

In practice, the restrictor 120 is done by molding, machining or 3D printing of a synthetic material more flexible than the material making up the coupling 102. For example, the coupling 102 can be made from steel or brass, while the restrictor 102 is made from elastomer. This allows the restrictor 120 to adapt to the inner shape of the connecting member 102 and to ensure the sealing between the parts 102 and 120.

Alternatively, the restrictor 120 can be made from a metal, for example bronze.

At the end of the insertion of the restrictor 120 into the connecting member 102, the sprayer is in the configuration of FIG. 5, where the outer surface 122 of the restrictor substantially marries the inner shape of the coupling 102, while the collar 134 protrudes from the volume V102.

It is then possible to connect the hose 14 on the sprayer 8 by introducing the front surface 114 of the coupling element 108 into the mouth 132 of the restrictor 120, then screwing the nut 106 on the thread 104 of the connecting member 102. This results in compressing the upstream end 130 of the restrictor 120 between the mouth 112 and the surface 114, which ensures good sealing at the interface between the member 102 and the element 108. In this case, the engagement length between the inner tapping of the nut 106 and the thread 104 is shorter than the engagement length between this tapping and this thread without the restrictor 120.

Thus, the member 102 is configured to cooperate with the elements 106 and 108 both with the restrictor 120 being absent, and with the restrictor 120 being present in the volume V102.

Figure 6:
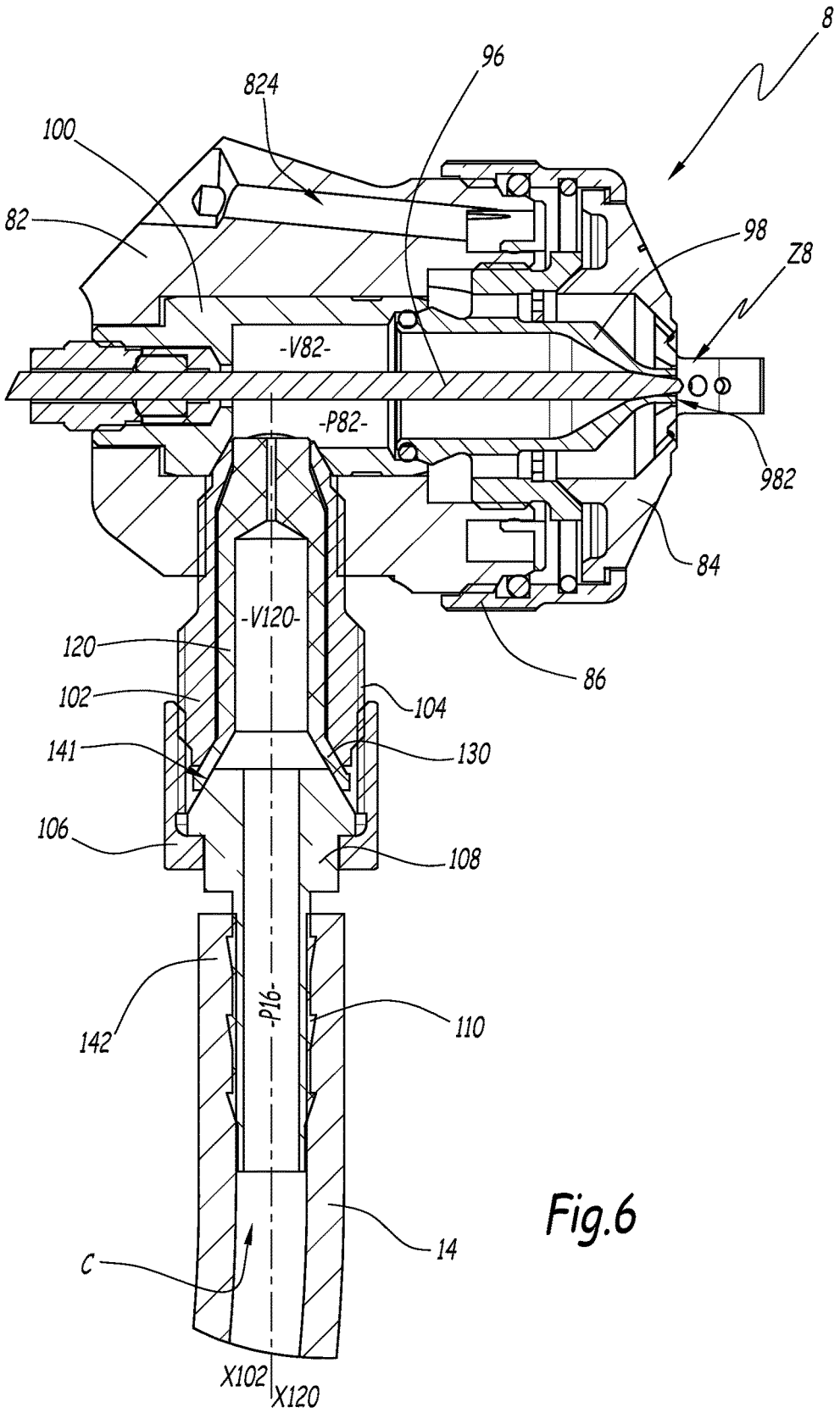
FIG. 6 is a sectional view similar to FIGS. 2 and 5, when the sprayer equipped with the restrictor is connected to a coating product supply hose.

In the configuration of FIG. 6, the pressure in the hose 14 and up to inside the volume V120 is substantially equal to the pressure P16 regulated by the regulator 16, while considering the pressure losses in the supply line 14 to be negligible.

The pressure P82 in the volume 82 can be significantly lower than the pressure P16 because a significant pressure loss is created by the restriction formed by the calibrated pipe 128.

In practice, the diameter d128 of the pipe 128 can be chosen to be equal to 0.8 mm, 0.9 mm, 1 mm, 1.2 mm, 1.4 mm or 1.8 mm, which makes it possible to adapt the pressure P82 to the nature of the coating product that must be sprayed, in particular to its viscosity.

The use of the restrictor 120 makes it possible for the pressure P82 to be less than 1 bar, for example between 0.3 and 0.7 bars, while the pressure P16 is comprised between 0.5 and 3 bars.

In practice, the restrictor 120 makes up a wearing part that can be mounted reversibly and without tools inside the connecting member 102 and that avoids retention areas for coating product contained in its inner shape, in particular due to the gradual decrease in the passage section due to the frustoconical surface 123*b*. No tool is necessary to install the restrictor 120 in the coupling 102 by pushing it in the direction of the arrow F1. A traditional key is sufficient to tighten the nut 106 on the connecting member 102. When the restrictor 120 must be disassembled, it suffices to loosen the nut 106 with a key, then to pull on the collar 134 parallel to the axis X102, in a separating direction relative to the body 82 opposite that of the arrow F1. It is therefore easy to adapt the pressure loss created by the restrictor 120, i.e., the pressure P82 within the volume V82, by installing a restrictor 120 in the volume V102, the pipe 128 of said restrictor having a suitable length and maximum transverse direction.

According to one alternative of the invention that is not shown, the connecting member 102 can form a single piece with the body 82 or be fastened thereon in a manner other than by screwing.

Figure 7:
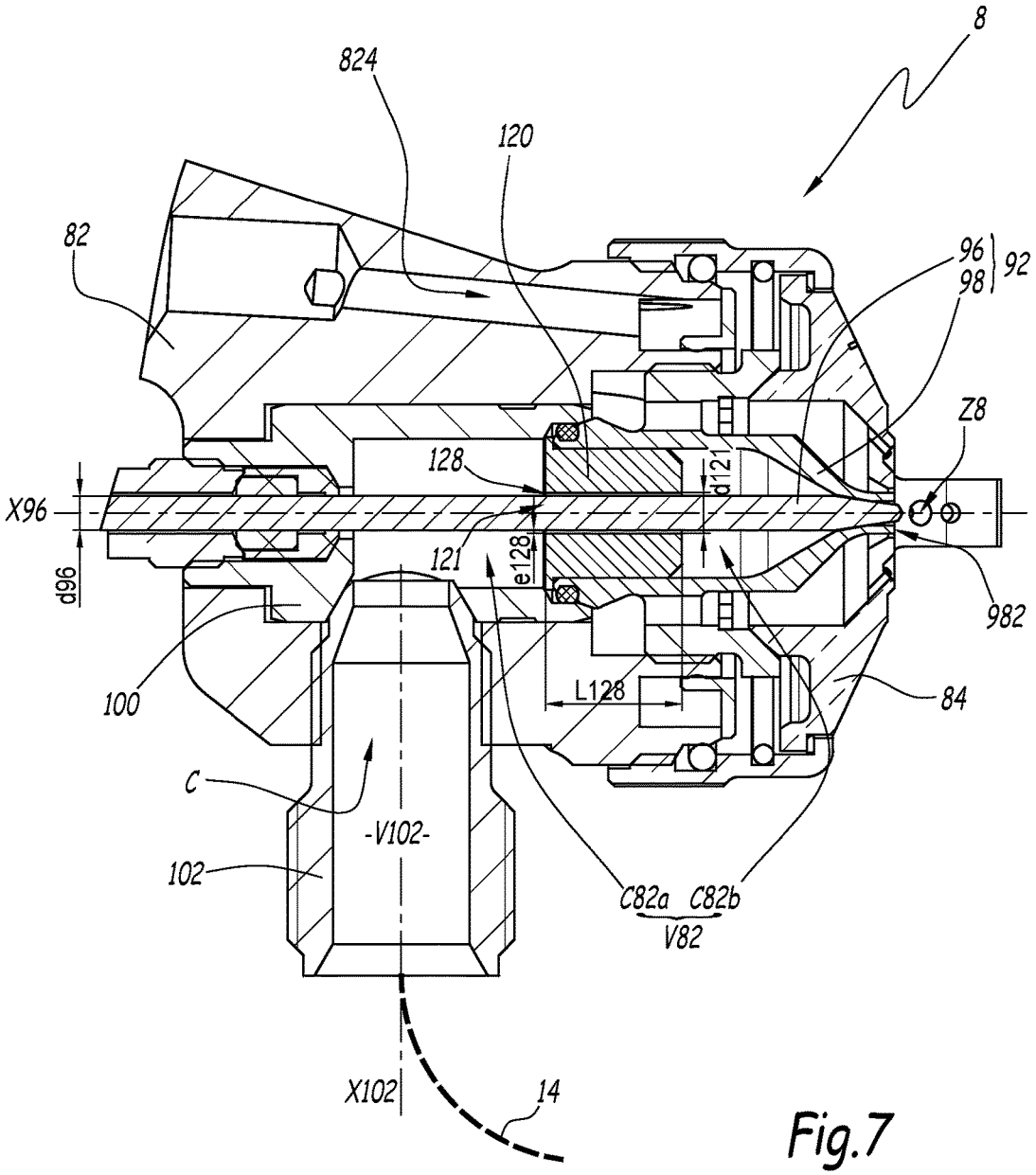
FIG. 7 is a sectional view similar to FIG. 2 for a sprayer belonging to a spraying assembly according to a second embodiment of the invention.

In the second embodiment of the invention shown in FIG. 7, the elements similar to those of the first embodiment bear the same references. Hereinafter, we only describe what distinguishes this embodiment from the previous one.

In this embodiment, the restrictor 120 is mounted not in the connecting member 102, but inside the volume V82, i.e., within the body 82. More specifically, the restrictor 120 divides the volume V82 into an upstream chamber C82*a* and a downstream chamber C82*b*. The needle 96 traverses a central bore 121 of the restrictor 120, most of the volume of which it occupies. More specifically, the diameter d121 of the bore 120 is slightly larger than the diameter d96 of the needle 96, for example by 5 to 10%, such that a calibrated annular pipe 128, the thickness of which measured radially to a longitudinal axis X96 of the needle 96 is denoted e128, is formed around the needle 96 and inside the restrictor 120.

Reference L128 also denotes the length of this calibrated pipe 128.

As before, the length L128 and the radial thickness e128 are chosen to create a pressure loss on the flow path C of the coating product. This flow path C extends from the upstream end of a supply line 14, defined as in the first embodiment, to the outlet orifice 982 of the nozzle 98, this flow path comprising a hose making up the line 14, the inner volume V102 of the member 102, the chamber C82*a*, the pipe 128 and the chamber C82*b*.

In practice, the length L128 is chosen between 1 and 25 mm, preferably between 8 and 15 mm, still more preferably about 10 mm, while the radial thickness e128 is chosen to be less than 2 mm, preferably between 0.5 and 1.8 mm.

According to one alternative of the invention that is not shown, one or several longitudinal pipes parallel to the axis X96 can be pierced in the material of the restrictor 120, to increase the passage section between the chambers C82*a* and C82*b*. These pipes can be used in addition to or in place of the pipe 128 that surrounds the needle 96.

According to another embodiment of the invention that is not shown, the restrictor 120 can be integrated within the hose making up the supply line 14.

However, this restrictor is preferably integrated into the flow path for the coating product in an area close to the outlet orifice 982, i.e., as close as possible to the downstream end 142 of the line 14 or within the sprayer 8, as in the two embodiments shown in the figures.

Irrespective of the embodiment, the installation of the restrictor 120 in the connecting member 102, in the body 82 or elsewhere in the flow path C of the sprayer 8 therefore makes it possible to maintain a relatively high pressure P16 in an upstream part of the hose that forms the pipe 14, while the pressure P82 of the coating product at the outlet of the volume V82 and the pressure of this product in the spraying area Z8 are low and adapted to the viscosity of the sprayed coating product.

This allows the supply of several sprayers 8 from a same pump 10 and under a same pressure, which proves quite advantageous in practice, simultaneously in terms of bulk, cost and maintenance.

According to one alternative of the invention that is not shown, the latter may be implemented with an electrostatic sprayer.

The embodiments and alternatives considered above can be combined to provide new embodiments of the invention.

The invention claimed is:

1. A pneumatic spraying assembly for a coating product, comprising:

a pneumatic sprayer for spraying the coating product, comprising;

a sprayer body; and a control valve for controlling flow of the coating product toward a spraying area for the coating product, comprising a needle for selectively closing off an outlet orifice of an inner volume of the sprayer body, and a supply line for supplying said pneumatic sprayer from a pressurized coating product source to which the supply line is connected by an upstream end of the supply line, wherein the pneumatic spraying assembly defines a flow path for the coating product, from the upstream end of said supply line to the outlet orifice of the inner volume, the flow path comprising the inner volume and a connecting member for connecting said supply line on said sprayer body, and wherein a restrictor for restricting flow of the coating product is mounted in the connecting member, to create a pressure loss upstream from the outlet orifice, the restrictor being made from a material more flexible than a material of the connecting member.

2. The assembly according to claim 1, wherein the restrictor is mounted in the inner volume of the sprayer body.

3. The assembly according to claim 2, wherein the restrictor is mounted reversibly in the inner volume.

4. The assembly according to claim 2, wherein the restrictor divides the inner volume into two chambers and connects the two chambers by at least one calibrated pipe.

5. The assembly according to claim 1, wherein the connecting member is configured to cooperate with a mechanism arranged at an outlet of said supply line, in order to connect said pneumatic sprayer to said supply line, both in absence of the restrictor, and when the restrictor is mounted in the connecting member.

6. The assembly according to claim 5, wherein the restrictor has a mouth having a geometry that is the same as a geometry of a mouth of the connecting member.

7. The assembly according to claim 1, wherein the restrictor is made from a synthetic material.

8. The assembly according to claim 1, wherein the restrictor is formed by a piece that defines at least one tubular-shaped calibrated pipe with a constant transverse section for flow of a coating product, the inner volume having a diameter strictly larger than the maximum transverse dimension of the calibrated pipe, and wherein the restrictor is mounted reversibly in the connecting member.

9. The assembly according to claim 1, wherein a cross-section of the flow path decreases gradually between that of a portion situated upstream from the restrictor and that of a calibrated pipe formed by the restrictor.

10. A restrictor for a pneumatic spraying assembly, the restrictor being formed by a piece that defines at least one tubular-shaped calibrated pipe with a constant transverse section for flow of a coating product, the calibrated pipe having a length between 1 and 25 mm and having a maximum transverse dimension less than 2 mm, the restrictor defining an inner volume between a mouth of the restrictor and the calibrated pipe, the inner volume having a diameter strictly larger than the maximum transverse dimension of the calibrated pipe, wherein the pneumatic spraying assembly comprises a pneumatic sprayer for spraying the coating product and a supply line for supplying the pneumatic sprayer from a pressurized coating product source to which the supply line is connected by an upstream end of the supply line, wherein the pneumatic sprayer comprises a sprayer body and a control valve for controlling flow of the coating product toward a spraying area for the coating product, wherein the control valve comprises a needle for selectively closing off an outlet orifice of the inner volume of the sprayer body, the pneumatic spraying assembly defining a flow path for the coating product, from the upstream end of the supply line to the outlet orifice of the inner volume, and wherein the restrictor restricts flow of the coating product and is mounted on the flow path, to create a pressure loss upstream from the outlet orifice.

11. The restrictor according to claim 10, wherein the length of the at least one calibrated pipe is comprised between 8 and 15 mm.

12. The restrictor according to claim 10, wherein the length of the at least one calibrated pipe is 10 mm.

13. The restrictor according to claim 10, wherein the maximum transverse dimension of the at least one calibrated pipe is comprised between 0.5 and 1.8 mm.

14. The restrictor according to claim 10, wherein an end of the restrictor, which defines a mouth thereof, has frusto-conical outer and inner shapes which have apical angles having a same value.

15. An installation for spraying a coating product, comprising:

at least one reservoir for the coating product;

at least one pneumatic sprayer for the coating product, each pneumatic sprayer comprising:

a sprayer body; and a control valve for controlling flow of the coating product toward a spraying area for the coating product, the control valve comprising a needle for selectively closing off an outlet orifice of an inner volume of said sprayer body;

a supply pump for supplying the at least one pneumatic sprayer with the coating product from the at least one reservoir; and a supply line for supplying the at least one pneumatic sprayer from the supply pump, wherein said at least one pneumatic sprayer and said supply line form an assembly defining at least one flow path for the coating product, from the upstream end of the supply line to the outlet orifice of the at least one inner volume, each flow path comprising a connecting member for connecting said supply line on each sprayer body, and wherein a restrictor for restricting flow of the coating product is mounted on each flow path to create a pressure loss upstream from the outlet orifice, the restrictor being made from a material more flexible than a material of the connecting member.

16. The installation according to claim 15, wherein the supply pump is equipped, at an outlet of the supply pump, with a pressure regulator adjusted to deliver the coating product to the supply line, under a first pressure comprised between 0.5 and 3 bars, and wherein the restrictor is configured to deliver the coating product to the outlet orifice under a second pressure below 1 bar.

17. The installation according to claim 16, wherein the second pressure under which the restrictor is configured to deliver the coating product to the outlet orifice is between 0.3 and 0.7 bars.

* * * * *